US010094249B1

(12) United States Patent
Nagaraj

(10) Patent No.: US 10,094,249 B1
(45) Date of Patent: Oct. 9, 2018

(54) ROCKER ARM WITH INTEGRATED GEAR TRAIN

(71) Applicant: Schaeffler Technologies AG & Co. KG, Herzogenaurach (DE)

(72) Inventor: Sumukha Nagaraj, Southfield, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 21 days.

(21) Appl. No.: 15/462,091

(22) Filed: Mar. 17, 2017

(51) Int. Cl.

| | |
|---|---|
| ***F01L 1/18*** | (2006.01) |
| ***F01L 1/22*** | (2006.01) |
| ***F01L 1/047*** | (2006.01) |
| ***F01L 1/46*** | (2006.01) |

(52) U.S. Cl.
CPC ..... *F01L 1/22* (2013.01); *F01L 1/047* (2013.01); *F01L 1/181* (2013.01); *F01L 1/46* (2013.01); *F01L 2001/186* (2013.01)

(58) Field of Classification Search
CPC ... F01L 1/047; F01L 1/22; F01L 1/181; F01L 2001/186
USPC ..... 123/90.39, 90.44
See application file for complete search history.

(56) References Cited

U.S. PATENT DOCUMENTS

| | | | | |
|---|---|---|---|---|
| 5,732,670 | A | 3/1998 | Mote, Sr. | |
| 6,109,226 | A | 8/2000 | Mote, Sr. | |
| 7,617,807 | B2 * | 11/2009 | Diggs | F01L 1/146 123/90.39 |

* cited by examiner

*Primary Examiner* — Ching Chang
(74) *Attorney, Agent, or Firm* — Volpe and Koenig, P.C.

(57) ABSTRACT

A switchable rocker arm is provided having first and second arms. The first arm has a first outer end and a first inner end and the second arm has a second outer end a second inner end, with the first and second outer ends contacting a respective one of a cam or a valve. One of the first and second inner ends includes an opening with a ring gear and the other includes at least one support for a planet gear that engages the ring gear. A sun gear is located on a rocker shaft and engages the planet gear. A locking mechanism is switchable from a locked position, in which the sun gear is rotationally fixed to the rocker shaft to transfer a cam lift to the valve via the gear ratio provided in the sun, planet, and ring gear arrangement, and a release position, in which the sun gear is rotatable on the rocker shaft so no cam lift is transferred.

20 Claims, 3 Drawing Sheets

ROCKER ARM WITH INTEGRATED GEAR TRAIN

FIELD OF INVENTION

The invention relates to rocker arms that are used in internal combustion engines and, more particularly, to rocker arms that can provide different force and/or lift transfer ratios as well as allow for a no lift mode.

BACKGROUND

New engines are being pushed to the limits which require greater valve openings. This requires a higher lift which can only be accomplished with rocker ratios that extend beyond the limits of the present day rocker arms and space availability in the engine head(s). Geared rocker valve operations for internal combustion engines are known from U.S. Pat. No. 5,732,670 as well as U.S. Pat. No. 6,109,226. However, these available solutions have a very small gear ratio. Additionally, they can have backlash and require more space. This places additional demands on redesigning the valve train to accommodate the increased space needs.

It would desirable to provide a drop in solution that allows for high lift and higher rocker ratios than previously available without increased space needs in the engine or the requirement to redesign the entire existing valve trains.

SUMMARY

Briefly stated, a switchable rocker arm is provided having first and second arms. The first arm has a first outer end and a first inner end and the second arm has a second outer end a second inner end, with the first outer end being adapted to contact one of a cam or a valve, and the second outer end being adapted to contact the other of the valve or the cam. One of the first and second inner ends includes an opening with a ring gear and the other of the first and second inner ends includes at least one support for at least one planet gear that engages the ring gear. A sun gear is located on a rocker shaft and engages at least one planet gear. A locking mechanism is provided that is switchable from a locked position, in which the sun gear is rotationally fixed to the rocker shaft to transfer a cam lift to the valve via the gear ratio provided in the sun, planet, and ring gear arrangement, and a release position, in which the sun gear is rotatable on the rocker shaft such that a cam lift is not transferred to the valve.

In one preferred arrangement, at least two of the planet gears engage with the ring gear and the sun gear. Preferably, a gear ratio formed by the sun gear, ring gear, and planet gear(s) is less than 1:1. This means that a smaller input from the cam results in a greater lift output on the valve. However, various other ratios as well as ratios greater than 1:1 can also be used In one preferred arrangement, the locking mechanism includes a slideable collar that is connected to the rocker shaft in a rotatably fixed manner, and an actuator that slides the collar at least one of into or out of engagement with the sun gear. The slidable collar can be actuated for axial movement by a solenoid or pressurized hydraulic fluid. In another preferred arrangement, the locking mechanism includes a movable pin that is movable from an engaged position in which the sun gear is held rotatably fixed to the rocker shaft, and a disengaged position in which the sun gear is rotatable on the rocker shaft. The movable pin can be actuated with pressurized hydraulic fluid or a solenoid.

The rocker shaft is preferably fixed to an engine component, such as an engine head.

In one preferred arrangement, the first arm includes a clevis at the first inner end, and the second arm includes a flange that is located in the clevis.

Preferably, the first and second inner ends of the first and second arms are rotatably supported on the rocker shaft.

In order to provide different lift and/or force profiles, preferably an arm length of the first arm is different than an arm length of the second arm. Here an even greater lift ratio can be provided if the first or second arm in contact with the cam is shorter than the other of the first or second arm that is in contact with the valve.

In a further aspect, the first and second arms are lockable together by a coupling pin which can then provide for a hi-lift, low-lift, and no-lift modes in the same switchable rocker arm.

In another aspect, a switchable rocker arm that is switchable between hi-lift, low-lift, and no-lift modes is provided, and includes first and second arms. The first arm has a first outer end and a first inner end and the second arm has a second outer end a second inner end, with the first outer end being adapted to contact one of a cam or a valve, and the second outer end being adapted to contact the other of the valve or the cam. One of the first and second inner ends includes an opening with a ring gear and the other of the first and second inner ends includes at least one support for at least one planet gear that engages the ring gear. A sun gear is located on a rocker shaft and engages the at least one planet gear, and a gear ratio formed by the sun gear, ring gear, and the at least one planet gear is less than 1:1 to provide the hi-lift mode. A locking mechanism is provided that is switchable from a locked position in which the sun gear is rotationally fixed to the rocker shaft to transfer a cam lift to the valve in the hi-lift mode, and a release position in which the sun gear is rotatable on the rocker shaft such that a cam lift is not transferred to the valve to provide the no-lift mode. A coupling pin is arranged to engage the first and second arms together that is movable between an unlocked position, in which the hi-lift and no-lift modes are carried out, and a locked position, in which the first and second arms are locked together to rotate in unison about the rocker shaft to provide a low-lift mode in conjunction with the locking mechanism being in the release position such that the sun gear is rotatable on the rocker shaft.

Additional features as noted above and in the description below can be used separately or in combination with the present switchable rocker arms. Other aspects of the invention are described below and in the claims, and have not been repeated here.

BRIEF DESCRIPTION OF THE DRAWINGS

The foregoing Summary and the following detailed description will be better understood when read in conjunction with the appended drawings, which illustrate a preferred embodiment of the invention. In the drawings.

DETAILED DESCRIPTION OF THE PREFERRED EMBODIMENTS

Figure 1:
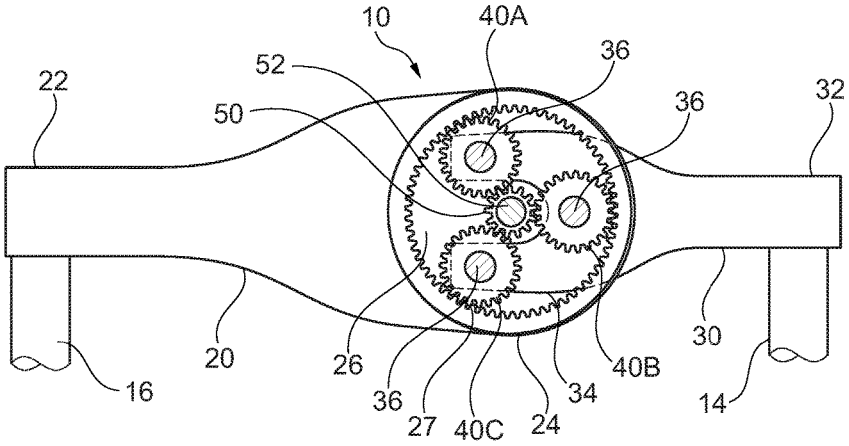
FIG. 1 is a side view, partially in cross-section, of a switchable rocker arm in accordance with a first embodiment.

Certain terminology is used in the following description for convenience only and is not limiting. The words "front," "rear," "upper" and "lower" designate directions in the drawings to which reference is made. The words "inwardly" and "outwardly" refer to directions toward and away from the parts referenced in the drawings. A reference to a list of items that are cited as "at least one of a, b, or c" (where a, b, and c represent the items being listed) means any single one of the items a, b, or c, or combinations thereof. The terminology includes the words specifically noted above, derivatives thereof and words of similar import.

Figure 2:
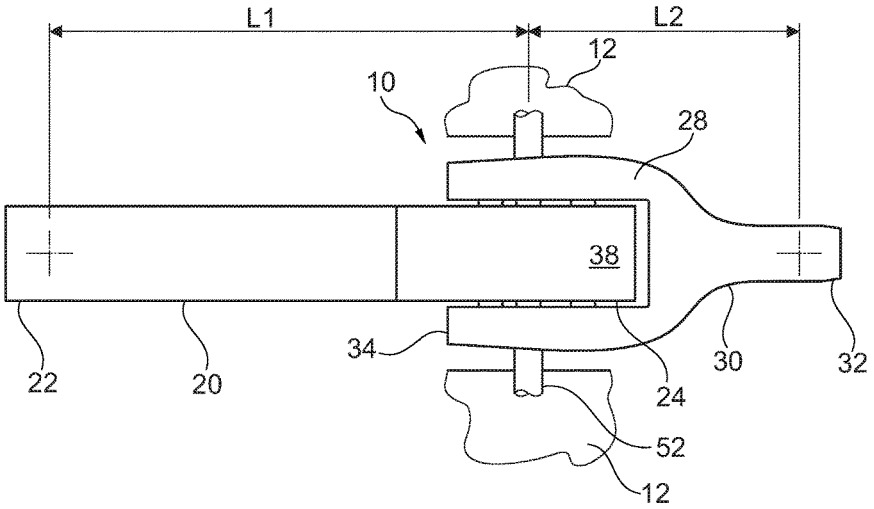
FIG. 2 is a top view of the switchable rocker arm shown in FIG. 1.

Referring to FIGS. 1 and 2, a switchable rocker arm 10 is shown. The switchable rocker arm 10 is preferably mounted to a head 12 of an engine via a rocker shaft 52. Preferably, the rocker shaft 52 is fixed. As shown in FIG. 1, the switchable rocker arm 10 acts between a cam, represented in block form at 14 and a valve, a stem of which is indicated at 16. The specific location of the cam 14 and valve 16 can be switched, depending upon the particular application, and the cam may act directly on the switchable rocker arm 10 or can have an intermediate tappet and/or push rod arrangement for transmitting a cam lift to the switchable rocker arm 10 for acting upon the oppositely located valve 16.

As shown in FIGS. 1 and 2, the switchable rocker arm 10 includes first and second arms 20, 30, with the first arm 20 having a first outer end 22 and a first inner end 24, and the second arm 30 having a second outer end 32 and a second inner end 34. The first outer end 22 is adapted to contact the cam 14 or the valve 16 and the second outer end 32 is adapted to contact the other of the valve 16 or the cam 14. In the illustrated embodiment, the second outer end 32 acts on the cam 14.

As shown in FIGS. 1 and 2, one of the first and second inner ends 24, 34, and in the illustrated embodiment, the first inner end 24, includes an opening 26 with a ring gear 27, and the other of the first and second inner ends 24, 34, and preferably the second inner end 34, includes at least one support 36 for at least one planet gear 40A that engages with the ring gear 27. In the illustrated embodiment, three planet gears 40A, 40B, 40C are shown. Those skilled in the art will recognize that the number of planet gears 40A-C can be varied and that preferably there are at least two circumferentially spaced apart planet gears 40A, 40B engaged with the ring gear 27. A sun gear 50 is located on the rocker shaft 52 and engages the at least one planet gear 40A-40C. In a preferred arrangement, a gear ratio formed by the sun gear 50, the ring gear 27, and the at least one planet gear 40A-40C is less than 1:1.

Figure 3:
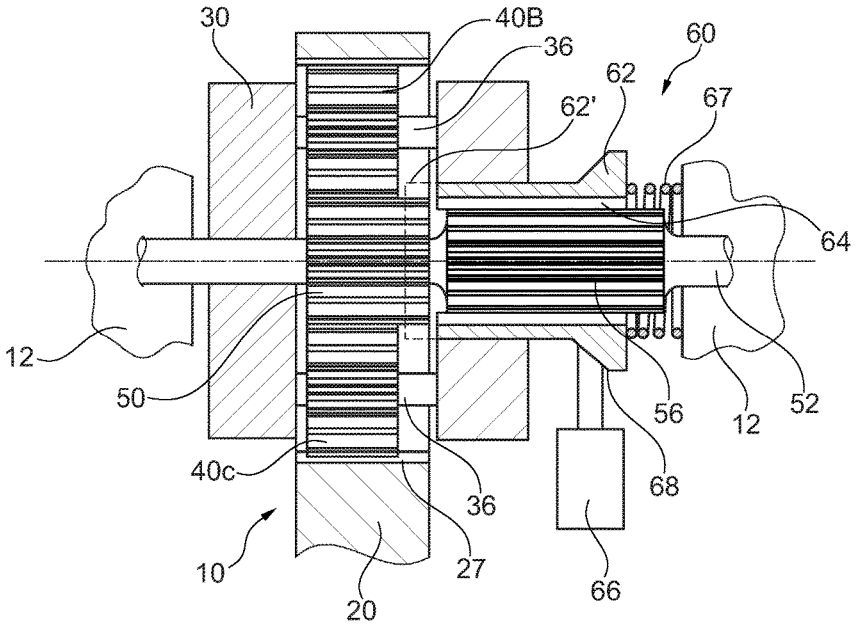
FIG. 3 is a cross-sectional view through the switchable rocker arm of FIGS. 1 and 2 showing a first sun gear locking mechanism.
Figure 4:
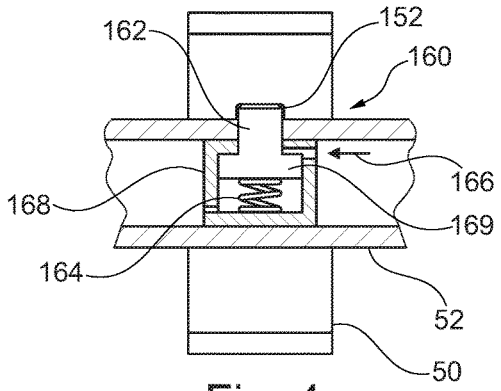
FIG. 4 is a partial cross-sectional view of the switchable rocker arm of FIGS. 1 and 2 showing a second sun gear locking mechanism.

Referring now to FIGS. 3 and 4, a locking mechanism 60, 160 is shown that is switchable from a locked position in which the sun gear 50 is rotationally fixed to the rocker shaft 52 to transfer a cam lift from the cam 14 to the valve 16, and a released position in which the sun gear is rotatable on the rocker shaft 52 in which a cam lift is not transferred from the cam 14 to the valve 16.

The locking mechanism 60 shown in FIG. 3 includes a slideable collar 62, shown in the released position, that is connected to the rocker shaft 52 in a rotatably fixed manner. This is preferably accomplished using splines 56 on the rocker shaft 52 that are slidably engaged with teeth 64 on the slideable collar 62. The splines 56 and the teeth 64 are axially aligned on the rocker shaft 52. The teeth 64 on the slideable collar 62 preferably also are designed to intermesh with the teeth of the sun gear 50. An actuator 66 slides the collar 62 at least one of into or out of engagement with the sun gear 50 and a spring 67 provides a return force. In one preferred arrangement, the actuator 66 includes an actuating pin with an angled face 68 that can be engaged in or removed from an angled surface 65 on the slideable collar 62 to cause the teeth 64 on the collar 62 to slide against the force of the spring 67 to disengage with the teeth of the sun gear 50. The return spring 67 provides the return force when the actuator is deactivated. Those skilled in the art will recognize that the position of the spring 67 could be changed to the other side of the collar 62 and the actuator 66 configured to provide the engaging force. The slideable collar 62 is shown in the engaged position at 62' in broken lines.

Referring to FIG. 4, a second embodiment 160 of the locking mechanism is shown. In the second embodiment of the locking mechanism 160, the rocker shaft 52 is hollow and includes a moveable locking pin 162 that is moveable from an engaged position in a corresponding recess 150 in the sun gear 50 so that the sun gear 50 is held rotatably fixed to the rocker shaft 52 as shown in FIG. 4, to a disengaged position in which the moveable pin 162 is retracted from the recess 152 such that the sun gear 50 is rotatable on the rocker shaft 52. In this case, the moveable pin 162 is preferably located in a housing 168 that can be pressed into the hollow rocker shaft 52, and the pin 162 is biased into the engaged position via a spring 164. Oil pressure can be provided to one side of a head 169 of the moveable pin 162 through a switchable hydraulic system (not shown) in order to retract the pin 162 from its engaged position in the corresponding recess 152 in the sun gear 50 so that the sun gear 50 is rotatable on the rocker shaft 52.

Those skilled in the art will recognize that other types of locking mechanisms can be used to switch the sun gear 50 from a rotationally fixed position on the rocker shaft 52 to a released position in which the sun gear 50 is rotatable on the rocker shift 52.

With the locking mechanism 60, 160 engaged such that the sun gear 50 is rotationally fixed to the rocker shaft 52, the switchable rocker arm 10 transfers lift from the cam 14 to the valve 16. The lever ratio of the first arm length L1 and the second arm length L2, shown in FIG. 2, can affect the lift ratio. However, for an even greater lift, depending upon the number of teeth on each of the ring gear 27, the planet gears 40A-40C, and the sun gear 50, different transmission ratios can be achieved within the same space to augment the lever ratio. For example, in one embodiment the sun gear 50 has 30 teeth and the ring gear has 72 teeth. The number of teeth on each of the gears is preferably held by the ratio R=2*P+S. In this case, if the input is the planet gears 40A-C and the output is the ring gear 27, the gear ratio provided equals 1/(1=S/R), which in the present example provides a gear ratio of 0.71:1. This would augment any lever ratio provided by the different arm lengths L1 and L2. The lever ratio and the gear ratio can both be used to vary the travel and/or the torque or loads on the arms for greater lift ratios as well as to control the force and torques being carried. Preferred ratios are in the range of 0.5:1 to 1.5:1, although any range can be selected depending on the application.

In one preferred arrangement as shown in FIG. 2, the first arm 20 includes a clevis 28 at the first inner end 24, and the second arm 30 includes a flange 38 at the second inner end 34 that is located in the clevis 28. However, as those skilled in the art will recognize, this arrangement could be reversed. In the preferred embodiment, the planet gears 40A-40C are located on planet shafts 36 that extend between the two sides of the clevis 28 such that the planet gears 40A-40C are located there between.

Preferably, both the first and second inner ends 24, 34 of the first and second arms 20, 30 are rotatably supported on the rocker shaft 50. Here, bushings or bearings can be used in order to reduce friction.

As discussed above, an arm length L1 on the first arm 20 can be different than an arm length L2 of the second arm 30 in order to achieve further variations in lift ratios between the cam and the valve.

Figure 5:
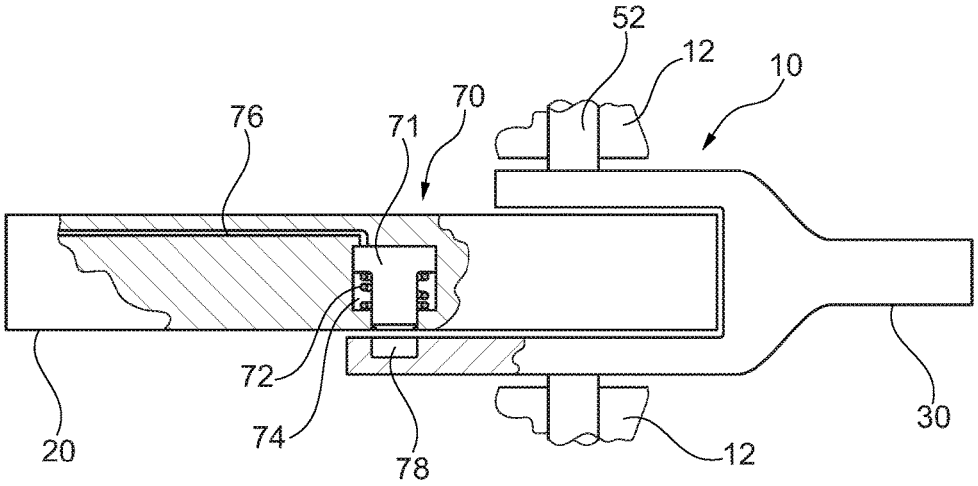
FIG. 5 is a top view, partially in cross-section, showing an optional coupling pin arrangement for connecting the first and second arms of the switchable rocker arm in FIGS. 1 and 2.

Referring now to FIG. 5, in one preferred optional arrangement, the first and second arms 20, 30 can be locked together via a coupling pin arrangement 70. As shown in FIG. 5, a coupling pin 71 can be arranged in one of the first or the second arms 20, 30, and in the illustrated embodiment, is arranged in the first arm 20. In this arrangement, the coupling pin 71 is preferably biased to the open position via a spring 74 such that the first and second arms 20, 30 can rotate relative to one another. The coupling pin 71 is located in a bore 74 in the first arm 20 and a hydraulic pressure feed line 76 is provided in communication with the bore 74 behind the pin 71 and can be used to actuate the coupling pin 71 to extend into a corresponding receiving opening 78 in the second arm 30 in a locked position in which the first and second arms 20, 30 rotate together. This provides a direct rocker lift ratio based only on the arm lengths L1, L2 that is operable when the locking mechanism 60, 160 is in a released position such that the sun gear 50 is rotatable on the rocker shaft 52. Those skilled in the art will recognize that other mechanisms can be used for locking the first and second arms 20, 30 together, if desired.

To the extent that the coupling pin arrangement 70 with the coupling pin 71 is used, this provides for the possibility of a switchable rocker arm 10 that is switchable between a hi-lift, a low-lift, and no-lift modes. The switchable rocker arm 10 with the coupling pin arrangement 70 is preferably used in connection with the gear ratio formed by the sun gear 50, the ring gear 27, and the at least one planet gear 40A-40C being less than 1:1 which provides a high-lift mode when the locking mechanism 60, 160 is in the locked position and the coupling pin arrangement 70 is in an unlocked position. Here, the lift ratio between the first arm 20 and the second arm 30 would be based on the gear ratio of the sun gear arrangement as well as any ratio between the first arm length L1 and the second arm length L2. The no-lift mode is provided when the locking mechanism 60, 160 is in the released position in which the sun gear 50 is rotatable on the rocker shaft 52. Here, no cam lift is transferred to the valve. Again, the coupling pin arrangement 70 is in the unlocked position.

In order to switch to a low-lift mode, the coupling pin arrangement 70 is moved to the locked position in which the first and second arms 20, 30 are locked together to rotate in unison about the rocker shaft 52. Here, the locking mechanism 60, 160 is in the unlocked position so that the sun, planet, ring gear arrangement is bypassed and the only lift ratio is provided by the ratio of the first arm length L1 to the second arm length L2.

With this arrangement including the locking mechanism 60, 160 as well as the coupling pin arrangement 70, additional functionality can be achieved using the switchable rocker arm 10.

In the preferred arrangements, the gear ratio for the sun gear 50, ring gear 27, the at least one planet gear 40A-40C may be in the range of 0.5:1 to 1:1.

Preferably, all of the gear components are formed of steel and may be forged and/or machined.

The drawings are not shown to scale.

While the preferred embodiment of the invention has been described in detail, those skilled in the art will recognize that other changes could be made to a switchable roller finger follower without departing from the scope of the present invention. Other types of coupling arrangements could be provided and the specific configuration of the inner lever and outer arms could be varied without departing from the scope of the present invention. Accordingly, the scope of the invention should not be limited by the preferred embodiments discussed above and instead should be defined by the claims as noted below.

LIST OF REFERENCE NUMBERS

10 switchable rocker arm
12 engine head
14 cam
16 valve
20 first arm
22 first outer end
24 first inner end
26 opening
27 ring gear
30 second arm
32 second outer end
34 second inner end
36 support
40A, B, C planet gears
50 sun gear
52 rocker shaft
56 splines on 52
60 locking mechanism
60' release position of 60
62 slideable collar
64 teeth on 62
66 actuator
67 spring
68 actuating ramp
70 coupling pin arrangement
71 pin
72 spring
74 bore
76 pressure feed line
78 receiving opening
160 locking mechanism
162 movable pin
164 spring
166 oil pressure path
168 housing
169 head

What is claimed is:

1. A switchable rocker arm, comprising:

first and second arms, the first arm has a first outer end and a first inner end and the second arm has a second outer end and a second inner end, the first outer end being adapted to contact one of a cam or a valve, and the second outer end being adapted to contact the other of the valve or the cam;

one of the first and second inner ends including an opening with a ring gear and the other of the first and second inner ends including at least one support for at least one planet gear that engages the ring gear;

a sun gear located on a rocker shaft and engages the at least one planet gear; and a locking mechanism that is switchable from a locked position in which the sun gear is rotationally fixed to the rocker shaft to transfer a cam lift to the valve, and a release position in which the sun gear is rotatable on the rocker shaft such that a cam lift is not transferred to the valve.

2. The switchable rocker arm of claim 1, wherein there are at least two of the planet gears engaged with the ring gear and the sun gear.

3. The switchable rocker arm of claim 1, wherein a gear ratio formed by the sun gear, ring gear, and the at least one planet gear is less than 1:1.

4. The switchable rocker arm of claim 1, wherein the locking mechanism includes a slideable collar that is connected to the rocker shaft in a rotatably fixed manner, and an actuator that slides the collar at least one of into or out of engagement with the sun gear.

5. The switchable rocker arm of claim 1, wherein the locking mechanism includes a movable pin that is movable from an engaged position in which the sun gear is held rotatably fixed to the rocker shaft and a disengaged position in which the sun gear is rotatable on the rocker shaft.

6. The switchable rocker arm of claim 1, wherein the rocker shaft is fixed to an engine component.

7. The switchable rocker arm of claim 1, wherein the first arm includes a clevis at the first inner end, and the second arm includes a flange at the second inner end that is located in the clevis.

8. The switchable rocker arm of claim 1, wherein the first and second inner ends are rotatably supported on the rocker shaft.

9. The switchable rocker arm of claim 1, wherein an arm length of the first arm is different than an arm length of the second arm.

10. The switchable rocker arm of claim 1, wherein the first and second arms are lockable together by a coupling pin arrangement.

11. A switchable rocker arm that is switchable between hi-lift, low-lift, and no-lift modes comprising:

first and second arms, the first arm has a first outer end and a first inner end and the second arm has a second outer end a second inner end, the first outer end being adapted to contact one of a cam or a valve, and the second outer end being adapted to contact the other of the valve or the cam;

one of the first and second inner ends including an opening with a ring gear and the other of the first and second inner ends including at least one support for at least one planet gear that engages the ring gear;

a sun gear located on a rocker shaft and engages the at least one planet gear, a gear ratio formed by the sun gear, ring gear, and the at least one planet gear is less than 1:1 to provide the hi-lift mode;

a locking mechanism that is switchable from a locked position in which the sun gear is rotationally fixed to the rocker shaft to transfer a cam lift to the valve in the high-lift mode, and a release position in which the sun gear is rotatable on the rocker shaft such that a cam lift is not transferred to the valve to provide the no-lift mode; and a coupling pin arrangement arranged to engage the first and second arms together that is movable between an unlocked position, in which the hi-lift and no-lift modes are carried out, and a locked position, in which the first and second arms are locked together to rotate in unison about the rocker shaft to provide a low-lift mode in conjunction with the locking mechanism being in the release position such that the sun gear is rotatable on the rocker shaft.

12. The switchable rocker arm of claim 11, wherein there are at least two of the planet gears engaged with the ring gear and the sun gear.

13. The switchable rocker arm of claim 11, wherein a gear ratio formed by the sun gear, ring gear, and the at least one planet gear is in a range of 0.5:1 to 1.5:1.

14. The switchable rocker arm of claim 11, wherein the locking mechanism includes a slideable collar that is connected to the rocker shaft in a rotatably fixed manner, and an actuator that slides the collar at least one of into or out of engagement with the sun gear.

15. The switchable rocker arm of claim 11, wherein the locking mechanism includes a movable pin that is movable from an engaged position in which the sun gear is held rotatably fixed to the rocker shaft and a disengaged position in which the sun gear is rotatable on the rocker shaft.

16. The switchable rocker arm of claim 11, wherein the rocker shaft is fixed to an engine component.

17. The switchable rocker arm of claim 11, wherein the first arm includes a clevis at the first inner end, and the second arm includes a flange that is located in the clevis.

18. The switchable rocker arm of claim 11, wherein the first and second inner ends are rotatably supported on the rocker shaft.

19. The switchable rocker arm of claim 11, wherein an arm length of the first arm is different than an arm length of the second arm.

20. The switchable rocker arm of claim 11, wherein the coupling pin arrangement includes a coupling pin arranged in one of the first or second arms that is extendible to engage in a corresponding recess in the other of the first or second arms in the locked position.

* * * * *